US006880734B2

(12) United States Patent
Baeke, Jr.

(10) Patent No.: US 6,880,734 B2
(45) Date of Patent: Apr. 19, 2005

(54) CONTAINER FOR DISPENSING LIQUIDS

(76) Inventor: John L. Baeke, Jr., 10522 W. 148th, Overland Park, KS (US) 66211

( * ) Notice: Subject to any disclaimer, the term of this patent is extended or adjusted under 35 U.S.C. 154(b) by 0 days.

(21) Appl. No.: 10/712,535

(22) Filed: Nov. 12, 2003

(65) Prior Publication Data

US 2004/0094581 A1 May 20, 2004

Related U.S. Application Data

(60) Provisional application No. 60/426,298, filed on Nov. 14, 2002.

(51) Int. Cl.[7] ..... B65D 47/00
(52) U.S. Cl. ..... 222/510; 222/541.4
(58) Field of Search ..... 222/541.4, 510, 222/541.2, 541.9, 83

(56) References Cited

U.S. PATENT DOCUMENTS 550,315 A * 11/1895 Allen ..... 215/26
4,109,814 A 8/1978 Rausing
4,211,247 A 7/1980 Morganroth
4,513,883 A * 4/1985 Melzi et al. ..... 222/83
4,938,390 A * 7/1990 Markva ..... 222/541.4
4,953,706 A * 9/1990 Piccard ..... 222/83
5,123,570 A * 6/1992 Dubow et al. ..... 222/83
5,464,133 A * 11/1995 Drummond ..... 222/510
5,634,504 A * 6/1997 Chandler ..... 222/541.4
5,947,344 A 9/1999 Jangaard
6,216,923 B1 4/2001 Cech

* cited by examiner

*Primary Examiner*—Philippe Derakshani
(74) *Attorney, Agent, or Firm*—Chase Law Firm, L.C.

(57) ABSTRACT

A container for pouring liquids or other substances and having a seal that may be broken after the container is inverted by pulling a handle linked to the seal or by squeezing the bottle to rupture the seal.

14 Claims, 2 Drawing Sheets

CONTAINER FOR DISPENSING LIQUIDS

CROSS REFERENCE TO RELATED APPLICATION

This application claims the benefit of a prior filed, co-pending application Ser. No. 60/426,298, filed Nov. 14, 2002, entitled CONTAINER FOR DISPENSING LIQUIDS.

BACKGROUND OF THE INVENTION

This invention relates to liquid containers and, more particularly, to a container whereby liquids can be released from the container in a controlled fashion after the bottle has been inverted.

A common problem exists when one is attempting to pour liquid from a bottle into a receptacle where the receptacle is difficult to reach or is relatively small or the bottle must be tipped or partially inverted in order to reach the receptacle. This problem is encountered when replacing a drinking water five-gallon bottle that must be inverted on the dispensing stand or when adding a fuel additive to a fuel tank of an automobile, or adding oil to an engine, to name a few examples. Often, when attempting to pour the liquid into the relatively small receptacle, the liquid is spilled on the surrounding surface such as the paint on the side of the automobile. The spilled liquid may damage the paint or present an environmental hazard.

A similar problem exists when one is attempting to pour oil into an automobile engine crankcase. Typically the oil fill receptacle is located deep within the engine bay. This means that the process required to pour the oil from the open, disposable bottle will usually result in spillage of oil over the engine and the operator's hands before the target receptacle has been successfully hit by the spout of the opened oil bottle. Use of a funnel reduces the chance of spillage on the engine. However, pouring oil from a full bottle often nevertheless results in the oil spilling down the side of the funnel and consequently onto the engine or the operator's hands. Furthermore, most motorists will not have a funnel readily available.

Accordingly, it is an object of the present invention to provide a bottle whereby liquids may be released from the bottle in a controlled fashion by the operator after the bottle has been inverted.

Other objects and advantages of this invention will become apparent from the following description taken in connection with the accompanying drawings, wherein is set forth by way of illustration and example, a now preferred embodiment of this invention.

DETAILED DESCRIPTION OF THE INVENTION

Figure 1:
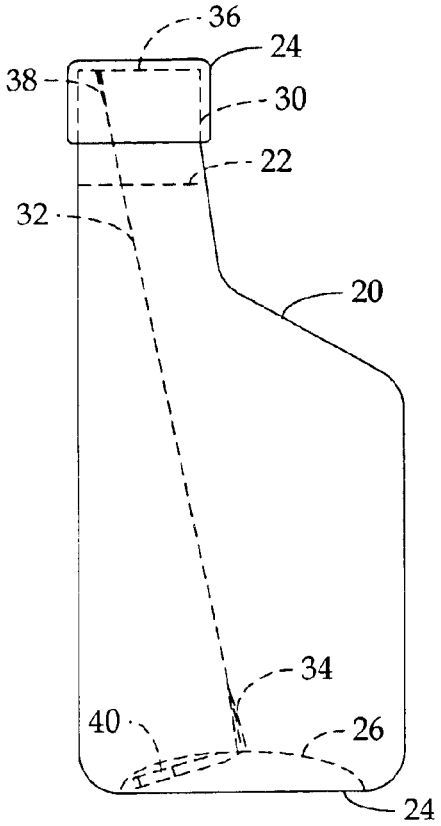
FIG. 1 is a front view of a container of the present invention.
Figure 2:
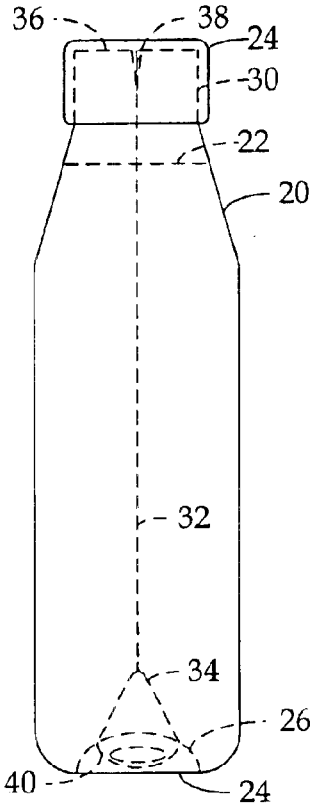
FIG. 2 is a side view of the container of FIG. 1.

Turning more particularly to the drawings, FIGS. 1 and 2 illustrate a container 20 for holding a liquid 22, such as oil, water, or other chemical, for example. Bottle 20 comprises a bottom or base 24 having a flexible floor 26, a threaded cap or lid 28 covering the neck 30 of bottle 20. A tether 32 extends from a web 34 attached to the interior surface of floor 26 through liquid 22 to the interior surface of seal 36. Seal 36 is secured across the opening of bottle 20 to seal liquid 22 in bottle 20, with a liquid or thermal adhesive along the edge of the bottle opening, for example. Tether 32 may have a flared end 38 attached to seal 36 in order to provide a larger attachment surface area. A finger handle 40 is attached to the exterior surface of floor 26 opposite webbing 34 attached to the interior surface of floor 26. Tether 32 provides a link from the finger pull 40 to the seal 36.

Figure 3:
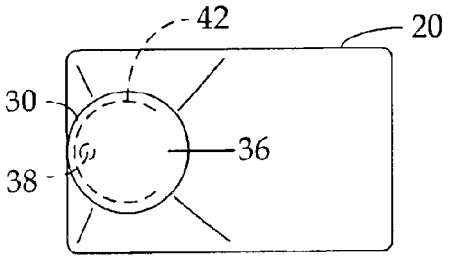
FIG. 3 is a top view of the container of FIG. 1.

Referring to FIG. 3, seal 36 is shown with cap 28 removed. Seal 36 is flush with the top of bottle 20 sealing in liquid 22. The flared end 38 of tether 32 is attached to the inside surface of seal 36 next to kerf cut 42. Kerf cut 42 may run part way around the perimeter of seal 36 as shown in FIG. 3 or completely around the perimeter of seal 36 (not shown). Alternatively, seal 36 may not have a kerf cut.

Figure 4:
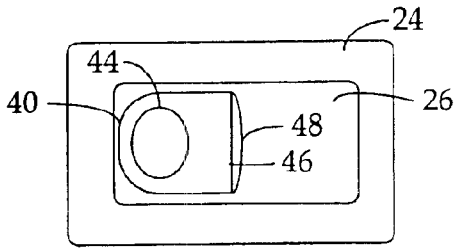
FIG. 4 is a bottom view of the container of FIG. 1.

Referring to FIG. 4, finger handle 40 has a finger aperture 44. Finger handle 40 is shown in a folded position along hinge or fold line 46 and is attached to concave floor 26 along line 48. Finger handle 40 is typically stored in a flush position, and popped-up for use as discussed hereinbelow.

Figure 6:
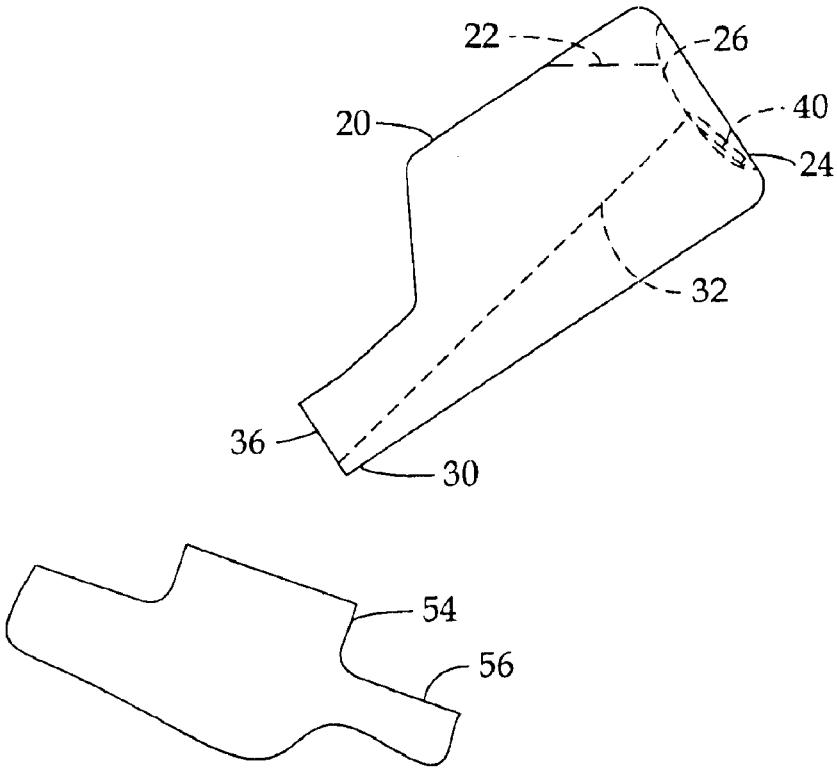
FIG. 6 is a diagrammatic illustration of the container of FIG. 1 in an inverted orientation positioned above a receptacle.

Referring to FIG. 6, bottle 20 is shown inverted with cap 28 removed. Seal 36 is intact preventing spillage of liquid 22 from bottle 20. Bottle 20 is positioned over a receptacle 54 such as an oil fill receptacle in an engine block 56 (shown in partial cut away).

Figure 7:
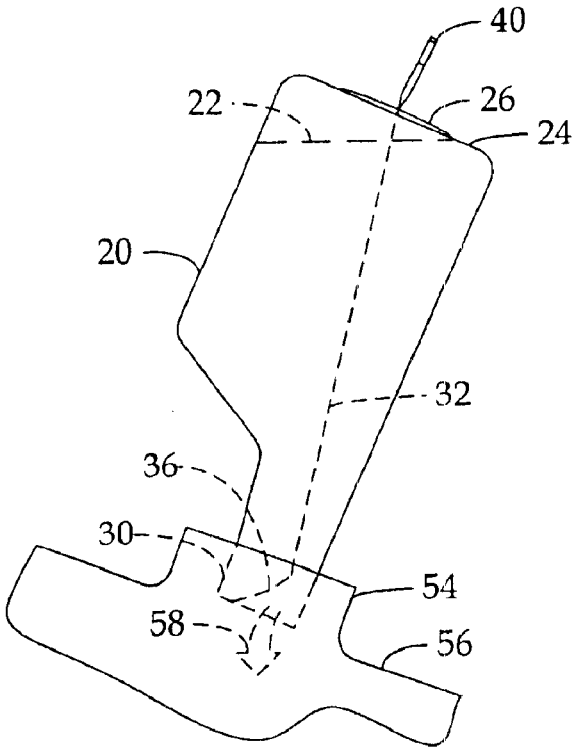
FIG. 7 is a diagrammatic illustration of the container of FIG. 1 in an inverted orientation and positioned within a receptacle and dispensing liquid.

Referring to FIG. 7, neck 30 of bottle 20 is inserted into receptacle 54. Finger handle 40 is popped-up into a generally perpendicular relationship to floor 26 and pulled. Floor 26 is flexed from a concave configuration to a flush or convex configuration. When finger handle 40 is pulled and floor 26 move from a concave to a flush or convex position, tether 32 pulls seal 36 which is torn along kerf cut 42 (see FIG. 3). Thus, liquid 22 is allowed to flow 58 from bottle 20 into crankcase 56 without spillage, for example.

In the preferred embodiment, bottle 20 is made of a flexible plastic. The floor 26 of bottle 20 has a memory so that during the life span of the bottle, floor 26 may be stored passively bowed inward or actively bowed outward. Finger handle 40 is typically stored in a flush position and popped up for use. Tether 32 on the inside of bottle 20 may be plastic or other material running from the center of the interior surface of floor 26 toward the mouth of bottle 20 and attaching to the interior surface of seal 36. Mouth and neck 30 of bottle 20 has a typical threaded cap with safety seal. Bottle 20 may be manufactured in one piece with the addition of a removable cap 28 using blow molding, injection molding or other techniques, for example.

Other applications include water bottles, such as stand alone water dispensers with a five-gallon, inverted water bottle used in an office environment. Using the container of the present invention, five-gallon water bottle may be inverted and placed on the water dispenser prior to opening, thus preventing spilling of the water. In another example, chemicals in plastic containers may be inverted prior to pouring into a holding tank such as a farm implement crop sprayer without exposing the operator to the liquid chemical.

Figure 5:
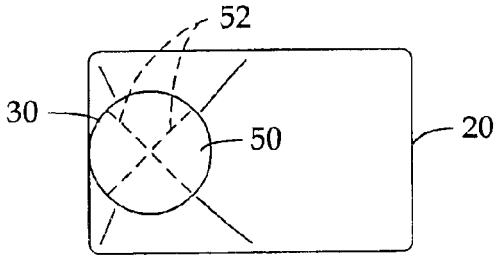
FIG. 5 is a top view of an alternate embodiment of the container of FIG. 1.

Referring to FIG. 5, an alternate embodiment is shown in which the kerf cut 52 in seal 50 is arranged in a cross pattern.

With the bottle 20 inverted and the neck 30 inserted into a receptacle, the sides of bottle 20 may be squeezed by the operator. The increased pressure against seal 50 is sufficient to rupture the kerf cut 52 and dispense the liquid into the receptacle. It is to be understood that other kerf cut patterns may be used with or without the tether.

It is to be understood that while certain now preferred forms of this invention have been illustrated and described, it is not limited thereto except insofar as such limitations are included in the following claims.

Having thus described the invention, what is claimed as new and desired to be secured by Letters Patent is:

1. A container for dispensing a substance comprising:

a bottle having an aperture and an at least one flexible side, said aperture having a periphery, said flexible side having an interior surface and an exterior surface;

a seal secured to said periphery of said aperture and having an interior surface and a kerf cut;

a tether having a first end secured to said interior surface of said seal proximal to said kerf cut and a second end secured to said interior surface of said flexible side; and a handle secured to said exterior surface of said flexible side proximate said second end of said tether secured to said interior surface of said flexible side;

said handle having a stored position wherein said handle is generally flush with the exterior surface of said flexible side, and an extended position wherein said handle extends from said exterior surface of said flexible side.

2. The container as claimed in claim 1 wherein said bottle is plastic.

3. The container as claimed in claim 1 wherein said kerf cut includes a first initial position and a second torn position corresponding to said first concave position of said flexible side and said second extended position of said flexible side whereby allowing said substance to flow from said bottle.

4. The container as claimed in claim 3 wherein said tether retains said seal when in said torn position whereby said seal is prevented from mixing with said substance.

5. The container as claimed in claim 1 wherein said kerf cut extends proximal said periphery.

6. The container as claimed in claim 1 wherein said kerf cut extends along the length of said periphery.

7. The container as claimed in claim 1 wherein said flexible side is the bottom of said bottle.

8. The container as claimed in claim 1 further comprising said flexible side having a first concave position and a second extended position.

9. A container for dispensing a liquid comprising:

a bottle having a top, a bottom and sides;

said top having an opening for pouring said liquid from said bottle;

said opening having a periphery;

said bottom having a flexible floor, said flexible floor movable between a first concave position and a second extended position, and having interior and exterior surfaces;

a seal secured to said periphery of said mouth and having an interior surface;

a tether having a first end secured to said interior surface of said seal and a second end secured to said interior surface of said flexible floor;

a pull tab secured to said exterior surface of said flexible floor proximate to said second end of said tether secured to said interior surface of said flexible floor;

said pull tab movable between a first position, stored position and a second released position;

said seal having a first secured position and a second open position whereby said seal is pulled from said periphery of said mouth in response to said flexible floor moving from said concave position to said extended position to release said liquid from said bottle.

10. The container as claimed in claim 9 further comprising a kerf cut in said interior surface of said seal between said first end of said tether and said periphery of said mouth, and whereby said seal is torn along said kerf cut in response to said flexible floor moving from said concave position to said extended position to release said liquid from said bottle.

11. The container as claimed in claim 10 wherein said kerf cut extends approximately one-half the length of said periphery.

12. The container as claimed in claim 10 wherein said kerf cut extends along the length of said periphery.

13. The container as claimed in claim 9 herein said tether retains said seal when in said open position.

14. The container as claimed in claim 9 wherein said bottle is plastic.

* * * * *